US010851987B2

(12) United States Patent
Towfigh

(10) Patent No.: US 10,851,987 B2
(45) Date of Patent: Dec. 1, 2020

(54) SHELVING SYSTEM WITH INTEGRATED LIGHTING

(71) Applicant: Rangine Corporation, Needham, MA (US)

(72) Inventor: Keivan Towfigh, Medford, MA (US)

(73) Assignee: Rangine Corporation, Needham, MA (US)

( * ) Notice: Subject to any disclaimer, the term of this patent is extended or adjusted under 35 U.S.C. 154(b) by 0 days.

(21) Appl. No.: 15/878,190

(22) Filed: Jan. 23, 2018

(65) Prior Publication Data

US 2019/0309938 A1 Oct. 10, 2019

(51) Int. Cl.
*F21V 33/00* (2006.01)
*A47B 96/02* (2006.01)
*F21Y 115/10* (2016.01)

(52) U.S. Cl.
CPC ..... *F21V 33/0012* (2013.01); *A47B 96/02* (2013.01); *A47B 2220/0077* (2013.01); *F21Y 2115/10* (2016.08)

(58) Field of Classification Search
CPC ... A47B 96/02; A47B 13/12; A47B 2220/007; A47B 2220/0077
USPC ..... 108/23
See application file for complete search history.

(56) References Cited

U.S. PATENT DOCUMENTS 8,979,296 B2 * 3/2015 Wiemer ..... A47F 5/103 362/125
9,222,645 B2 * 12/2015 Breslow ..... A47F 3/001
9,404,645 B1 * 8/2016 Feng ..... F21V 23/001
10,130,196 B2 * 11/2018 Burns ..... F21V 23/06
10,504,389 B2 * 12/2019 Tewksbury ..... A47F 11/06
2005/0237732 A1 * 10/2005 Lagman ..... A47B 57/40 362/132
2006/0181885 A1 * 8/2006 Seng Tong ..... A47B 96/02 362/382
2006/0209537 A1 * 9/2006 Stelmasik ..... A47F 11/10 362/217.16
2009/0207596 A1 * 8/2009 Richmond ..... F21V 21/0824 362/159
2010/0135020 A1 * 6/2010 Moore ..... A47F 11/10 362/249.02
2011/0084627 A1 * 4/2011 Sloan ..... F21S 4/20 315/297
2011/0164399 A1 * 7/2011 Driver ..... A47B 57/42 362/92
2013/0242561 A1 * 9/2013 Kramer ..... H01R 25/142 362/253
2014/0055987 A1 * 2/2014 Lindblom ..... A47F 3/001 362/125
2014/0198490 A1 * 7/2014 Halseth ..... A47F 11/10 362/147
2014/0224875 A1 * 8/2014 Slesinger ..... H01R 25/142 235/385
2014/0227893 A1 * 8/2014 Howard ..... A47B 97/00 439/121
2014/0235093 A1 * 8/2014 Harlan ..... A47B 97/00 439/370

(Continued)

*Primary Examiner* — Jose V Chen

(74) *Attorney, Agent, or Firm* — Bookstein IP Law

(57) ABSTRACT

The disclosure relates to illuminated shelving systems that incorporate a low voltage lighting system in which components of the system are electrically conductive and comprise part of the lighting circuitry.

19 Claims, 2 Drawing Sheets

(56) References Cited

U.S. PATENT DOCUMENTS

| | | | | |
|---|---|---|---|---|
| 2014/0376213 | A1* | 12/2014 | Miedema | F21V 33/0024 362/127 |
| 2015/0092397 | A1* | 4/2015 | Liu | A47F 11/10 362/127 |
| 2015/0223601 | A1* | 8/2015 | Zang | A47B 47/0083 108/23 |
| 2015/0289681 | A1* | 10/2015 | Sun | A47F 5/0043 108/23 |
| 2016/0316939 | A1* | 11/2016 | Kraiss | A47F 5/103 |
| 2017/0198871 | A1* | 7/2017 | Keenan | F21S 8/036 |
| 2017/0224135 | A1* | 8/2017 | Burns | F21V 23/06 |
| 2017/0329064 | A1* | 11/2017 | Dor | F21V 33/0012 |
| 2018/0014423 | A1* | 1/2018 | Chen | H05K 1/02 |
| 2018/0142846 | A1* | 5/2018 | Liu | A47F 11/10 |
| 2018/0180276 | A1* | 6/2018 | Zeng | A47F 3/001 |
| 2018/0306971 | A1* | 10/2018 | Conrad | G02B 6/0091 |
| 2018/0313108 | A1* | 11/2018 | Ciaccia | G09F 13/02 |
| 2019/0191894 | A1* | 6/2019 | Xu | A47F 5/0043 |
| 2019/0231068 | A1* | 8/2019 | Breslow | A47B 57/58 |
| 2019/0376655 | A1* | 12/2019 | Sburlan | A47G 23/0266 |

* cited by examiner

SHELVING SYSTEM WITH INTEGRATED LIGHTING

FIELD

The disclosure relates to illuminated shelving systems.

BACKGROUND

Shelving systems, particularly those systems sometimes referred to as "architectural" shelving systems often are employed in office, business and residential settings to serve a shelving function as well as to provide an attractive environment. In order to enhance the appearance as well as the function of such shelving systems it may be desirable to provide lighting to illuminate the shelves and articles that may be placed on display on the shelves. Another, often desirable, feature of such shelving systems is the ability of the system to be adjusted or reconfigured so that it can be adapted to accommodate different or changing uses or user needs, for example, by adjusting shelf spacing or positioning. It would be desirable to provide such an adjustable or reconfigurable shelving system with an integral lighting system that requires minimal adjustment of the lighting system when the shelving system is adjusted or reconfigured.

SUMMARY

The shelving system of the present invention includes a pair of generally vertically oriented supports such as standards or poles that may be secured to a wall or other suitable, stable supporting structure. Shelf support brackets are attachable to the vertical supports and extend horizontally to provide support for the shelves. The vertical supports as well as the shelf brackets typically are formed from an electrically conductive metal such as steel or aluminum and for architectural shelving often are coated with a finish coat such as a paint or, in the case of aluminum, an anodized surface to provide an aesthetically pleasing appearance. The lighting system of the present invention includes one or more strips of low voltage light emitting diodes (LEDs) that may be adhesively attached to the underside of one or more of the shelves. The LEDs are powered by a low voltage (e.g., 12 volts) electrical source. The circuit by which the LEDs are operated incorporates the vertical supports and shelf supports of the shelving system into the lighting circuitry and may also include the shelf in the circuitry. The invention enables wires and other components of the lighting system to be relatively concealed to enhance the aesthetics of the shelving system.

DESCRIPTION OF THE DRAWINGS

The advantages and objects of the invention will be appreciated more fully from the following description, with reference to the accompanying drawings in which.

DETAILED DESCRIPTION

Figure 1:
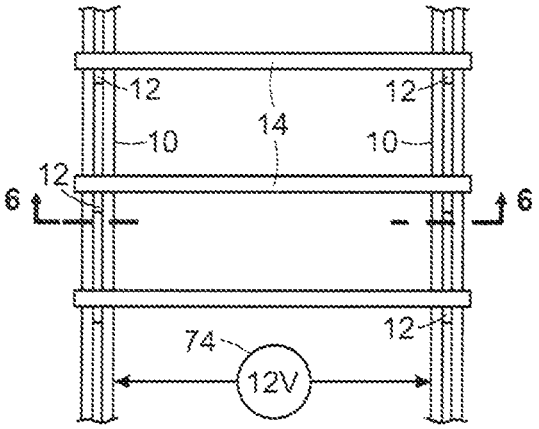
FIG. 1 is a diagrammatic elevation, illustrating a simple shelving system.

FIG. 1 shows a shelving system having two vertically mounted supports such as standards 10 that may be fastened, for example, to a wall. Each support 10 is adapted to receive and support one or more shelf brackets 12 that extend forwardly of their associated standard 10 and on which the shelves 14 may be placed. For example, the components of the shelving system may be of the type described in U.S. Pat. No. 3,865,337 in which the vertical supports 10 may be formed from an appropriate material such as, for example, extruded aluminum or other electrically conductive metal. As shown in the drawings of an exemplary support, the cross-sectional configuration of the support forms a channel 16 defined by a rear wall 18 and side walls 20. The channel 16 may be exposed along the length of the standard by a restricted longitudinal slot 22 defined by a pair of inwardly extending longitudinal flanges 24. The flanges 24 and rear and side walls 18, 20 define a somewhat T-shaped cross-sectional configuration for the channel 16. A pair of oblique longitudinal walls 26 may, optionally, extend from the forward corner of each side wall 20 rearwardly and outwardly so that their free edges 28 lie in substantially the same plane as the rear wall 18 of the standard 10. When the standard 10 is fastened to the wall, the edges 28 of the oblique walls 26 bear firmly against the wall and provide additional support for the standards. The vertical support 10 may be fastened to a wall by appropriate fasteners, such as flat head screws or bolts 30 extending through appropriate holes formed in the rear wall 18 of the standard. The fastener 30 preferably is countersunk within the rear wall 18 so that the forwardly facing inner surface 32 of the rear wall 18 presents a smooth planar surface. It should be understood, however, that the invention may be practiced with any of a variety of other configuration of vertical support configurations, the foregoing being merely one particular configuration for purposes of illustration.

The shelf brackets 12 may be formed simply from a suitably dimensioned electrically conductive bar in which at least the inner connective end of the bracket is of a width adapted to pass easily through and along the longitudinal slot 22. The inner end of the shelf bracket defines an inner edge 38 which is generally normal to the longitudinal supportive edge 40 of the bracket 12. In some instances, it may be desirable to fabricate the bracket 12 so that the shelf supporting edge 40 extends at a slight upward and outward incline to retain the shelf effectively without requiring shelf retaining projections at the end of the bracket as is employed commonly in the art. It should be noted, however, that in some instances it may be desirable for the shelf to be supported in a forwardly and downwardly inclined attitude. With such a configuration, the forward end of the shelf should have a lip and the forward end of the bracket 12 should have the means commonly employed to retain the shelf from sliding off of the bracket.

Figure 3:
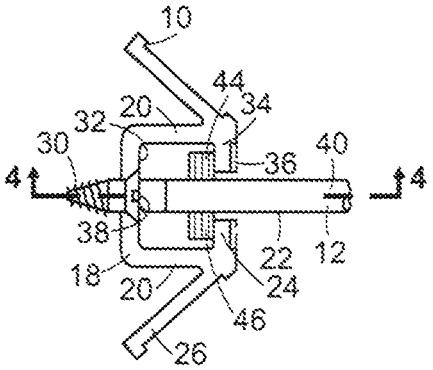
FIG. 3 is a sectional illustration of a shelf bracket locked to a support.
Figure 4:
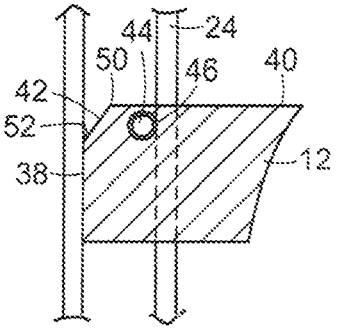
FIG. 4 is a sectional illustration as seen along the line F4-F4 of FIG. 3.
Figure 5:
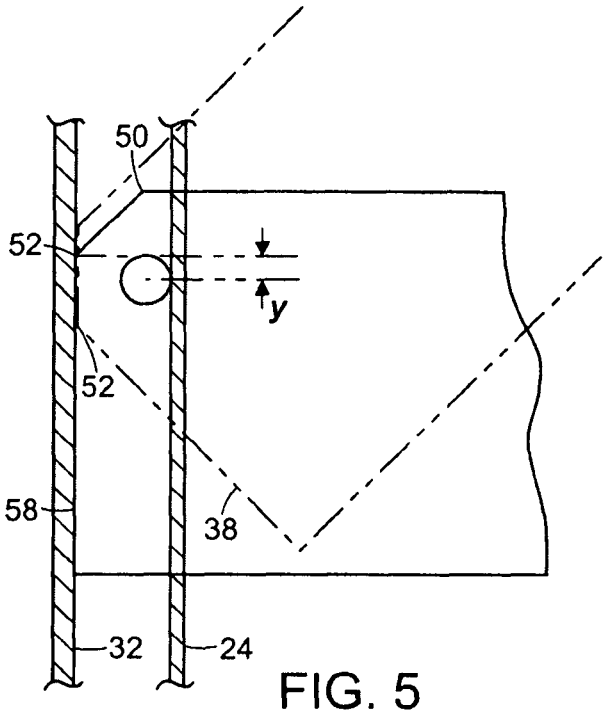
FIG. 5 is an illustration similar to that of FIG. 4 in which an inner corner of the shelf bracket is mitered.

The corner juncture between the edges 38, 40 of the bracket may be mitered as shown at 42 in FIGS. 4 and 5. The pin 44 is spaced forwardly of the inner edge 38 of the bracket so that when the inner edge 38 is in flush abutment with the rear wall 18 of the standard 10 the transverse end of the pins 44 and edge 38 of the bracket 12 will be wedged between and bear firmly against the inner surfaces of the slot-defining flanges 24 and the rear wall surface 32. The grip of the transverse pin 44 against the flanges 24 may be enhanced further by providing the pin with splines 46 as shown in FIG. 3. The relative dimensions of the pin 44, its spacing from the inner edge 38 of the bracket, and the depth of the channel 16 between the rearward wall 32 and the rearwardly facing surfaces of the flanges 24 may be selected so that the distance between the forward-most surface of the pin 44 and the inner edge 38 of the bracket 12 is slightly greater than the depth of the channel 16 as measured between the surface 32 and the rearwardly facing surface of the flanges 24. For example, with a standard in which the distance between the rear wall 32 and the inwardly facing surface of the flanges 24 is approximately 0.300 inches, the pin may be spaced from the inner edge 38 of the bracket 12 so that the forward-facing portion of the pin surface is approximately 0.305 inches. For standards and shelf brackets that may be jacketed with a surface layer that is relatively non-conductive, the parts preferably are dimensioned so that when the shelf bracket 123 is pivoted to a horizontal, shelf-supporting position, the corner region 42 or 43 digs into and scrapes away the frangible surface of the channel as well as scraping the corner region of the bracket sufficiently that a direct electrical contact between the shelf bracket and the vertical support is established for reasons discussed below. Additionally, the transverse ends of pin 46 may disrupt the surface layers of both the pin and the inner surface of the flanges 24 sufficiently to establish or enhance electrical contact between them as well. When the shelf is in its shelf-supporting configuration (horizontal as shown in FIGS. 2 and 4) the pin and inner edge 38 of the bracket are wedged firmly and securely within the channel.

Figure 2:
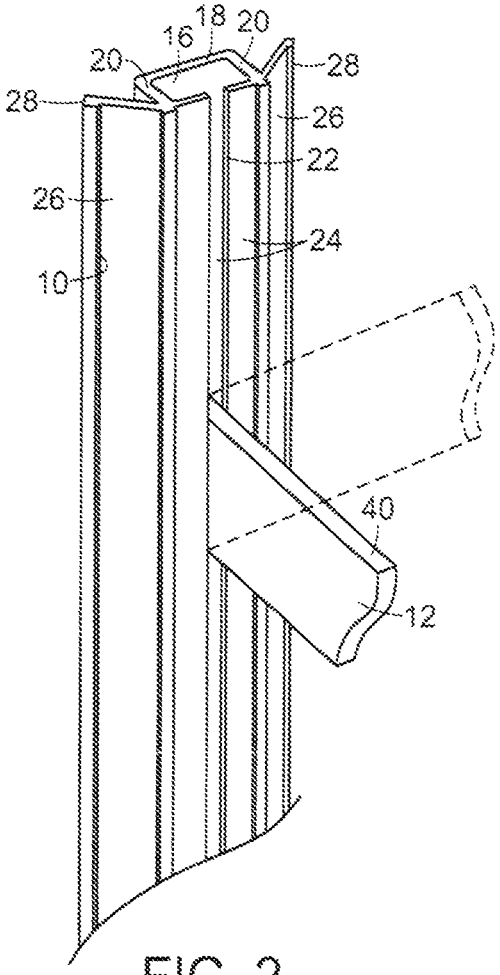
FIG. 2 is an illustration of a segment of a vertical support with an attached shelf bracket in locked and unlocked, adjustable, positions.

The bracket 12 may be inserted and selectively positioned within the channel by orienting it in an attitude as suggested in phantom in FIGS. 2 and 5 in which the forwardly extending end of the bracket 12 is swung to an upwardly inclined attitude. As suggested in phantom in FIG. 5, this effectively reduces the horizontal distance between the then inner most end of the bracket 12 and pin 44 and permits the bracket 12 to be moved vertically along and within the channel of the standard. The reduced corner juncture 42 or 43 permits the upward swinging of the bracket 12.

FIG. 5 shows the relative location of the pin 44 with the point on the inner edge 38 of the bracket 12 where the vertical portion merges into the reduced corner portion 42. The points defined by the mitered corner point are shown in FIGS. 4 and 5 at 50 and 52. The preferred embodiment of the invention includes a toggle-like action which is caused by spacing the pin 44 from the inner end of the bracket 12 as explained above and also by locating the pin slightly below the point 52 such as by the increment "y". By locating the pin 44 below point 52, downwardly swinging of the bracket 12 about point 52 or pin 44, or either of them requires the pin 44 to pass through a maximum horizontal spacing from point 52 in which both the point 52 and pin are in horizontal alignment. The parts of the bracket and standard are preferably designed to provide yieldable resistance to such action. After the pin has passed through the imaginary horizontal line in which the pin 44 and point are horizontally aligned, the resistance decreases because the horizontal distance between the pin and point 52 then begins to decrease. The parts are so structured, however, that when the inner edge 38 of the bracket 12 lies flush against the surface 32 of the standard, the horizontal spacing from the inner edge 38 to the portion of the pin which bears against the flange 24 is slightly more than that between the inner surface 32 of the standard at the inwardly facing surface flanges 24 to give the wedged-in-action discussed above. As the bracket swings through the point of resistance, the surface layer of the interfering parts is scraped away.

Heightwise adjustment of the bracket can be made, after the shelf 14 has been removed, by rotating the bracket 12 to swing its inner surface away from the rear wall of the channel thus permitting it to slide freely along and within the channel. The flush configuration of the fasteners 30 along the rear wall 18 provides for a smooth uninterrupted surface along which the bracket may be variably positioned.

Figure 6:
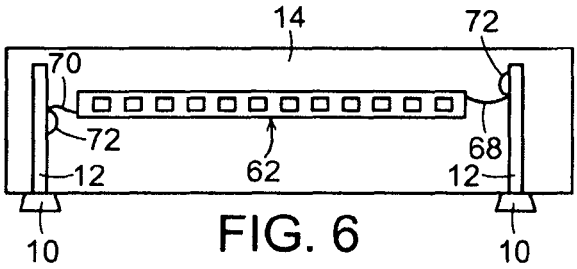
FIG. 6 is an illustration of the underside of a shelf having an LED strip attached in one embodiment of the invention and as seen along the line 6-6 of FIG. 1.
Figure 7:
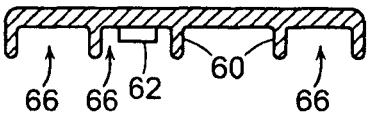
FIG. 7 is an end view of a shelf in another embodiment of the invention.
Figure 8:
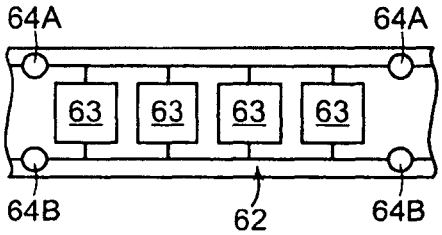
FIG. 8 is an enlarged, diagrammatic illustration of a portion of an LED strip as may be used in the practice of the invention.

FIG. 6 illustrates the underside of a shelf with an illuminating LED strip in one embodiment of the present invention and as seen along the line 6-6 of FIG. 1. The shelf 14, in this embodiment, may be formed from any suitable material and may be provided, optionally, with ribs 60 extending downwardly from the bottom surface of the shelf and along the length of the shelf (FIG. 7). One or more LED strips 62 having a plurality of low voltage (e.g., 12 volts) LEDs 63 is attached to the underside of the shelf as by adhesive. Such strips, illustrated diagrammatically in FIG. 8, are commercially available from a wide variety of suppliers in a wide variety of colors, sized and configurations. Typically, the LEDs are wired in parallel, having pairs of electrical contacts 64A, 64B at spaced locations along the strip from end to end. The strips may be cut to a desired length. For a shelf having ribs 60, the LED strips may be concealed in the channels 66 between the ribs 60. As shown in FIG. 8, one embodiment may comprise short jumper wires 68, 70 that may be connected to the contacts 64A, 64B at opposite ends of the LED strip and the other ends of the jumper wires 68, 70 are electrically connected to the nearest shelf bracket 12 as by screws 72 or plugs that are threaded onto and make electrical contact with the core material of the bracket. The power supply 74 (FIG. 1) may comprise a transformer with the requisite low voltage output connected electrically to the standards 10. Power is delivered to the LED strips 62 through the electrically conductive standards and the shelf brackets.

Figure 9:
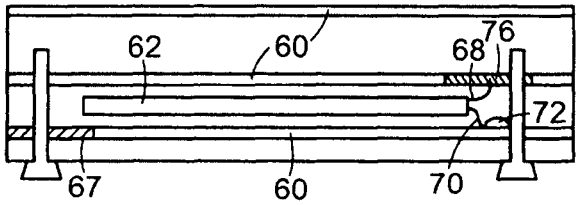
FIG. 9 is an illustration of the underside of a shelf having an LED strip attached in another embodiment of the invention.

FIG. 9 illustrates another embodiment of the invention in which the shelf 14 is formed from an electrically conductive metal and has an aesthetically pleasing outer protective coating such as paint or, in the case of aluminum, an anodized outer surface, but in which the protective coating is relatively electrically non-conductive. In this embodiment, the shelf also becomes part of the circuitry to power the LEDs and enables the LEDs to be automatically turned on (or off) simply by placing (or removing) the shelf on (or from) the shelf brackets. Placing the shelf on the shelf brackets completes the power circuit for the LEDs. In this embodiment, some of protective surface coating on the contacting regions 67 of the shelf and one of the shelf brackets are removed to expose the conductive base material and establish electrical contact when the shelf is in place. In this embodiment jumper wires 68, 70 may be attached to the contacts 64A, 64B at one end of the LED strip. The jumper wire 70 is attached electrically to the shelf, as by a screw. The other jumper wire 68 is attached to a strip 76 of conductive material (e.g., copper foil) that is mounted to but is electrically insulated from the shelf, as by an intermediate strip (not shown) of non-conductive material that may be adhesively attached to and between the shelf and the conductive strip 76. The conductive strip 76 may be located, for example, along the lower edge of one of the ribs 60, so that it will rest on and electrically contact the other of the shelf brackets 12. This embodiment enables the positioning of the shelves to be changed or adjusted without requiring any change or repositioning of the jumper wires or any other wiring. After the shelf supports have been repositioned the shelves need only to be placed on the shelf supports to activate the LEDs.

Figure 10:
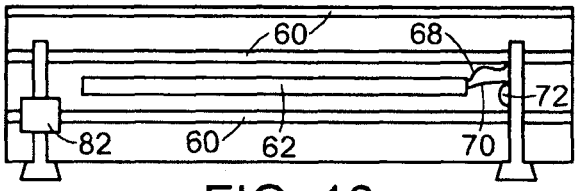
FIG. 10 is an illustration of the underside of a shelf having an LED strip attached in yet another embodiment of the invention.

FIG. 10 illustrates another embodiment of the invention in which a conductive shelf functions as a portion of the lighting circuitry. In this embodiment, an LED strip 62 is attached to the underside of the shelf 14. One of the jumper wire 68 is connected between one contact 64A and the shelf bracket and the other jumper wire 70 is connected between the other contact 64B and the shelf. Current is carried to the other end of the shelf from which is in electrical contact with the other shelf bracket and the standard to complete the circuit. The electrical contact between the shelf and the other bracket may be made as described above or may be made using a conduction block 82 that is fastened to each of the bracket and the shelf by a pair of set screws (not shown) that can be tightened sufficiently to break through the jacket of non-conductive material while also providing a secure connection of the bracket and shelf. The block 82 may have skewed grooves to receive the upper edge of the shelf bracket 12 and a rib 60 at the underside of the shelf.

It also should be understood that terms such as upward, downward, vertical, Heightwise, forward, rearward, transverse, inner outer, below and the like are intended only to indicate relative positions or directions of the various components of the invention and its manner of use.

From the foregoing, it will be appreciated that the invention provides a shelving system with integrated lighting in which electrically conductive components of the shelving system are incorporated into the lighting circuitry and in a manner, that minimizes the use of unsightly wiring, thus to provide an aesthetically pleasing, easily reconfigurable system.

It should be understood; however, the foregoing description of the invention is intended to be merely illustrative and that other embodiments, modifications and equivalents may be apparent to those skilled in the art without departing from the principles of the invention. For example only, although the invention has been described primarily in relation to a shelving arrangement which may be secured to a wall, it is equally applicable to other systems such as, for example, where the standard is free standing and is supported at its lower end, upper end, or either of them. In addition, the bracket may be modified to support other than shelves.

The invention claimed is:

1. An illuminated shelving system comprising:

a shelf;

at least two spaced heightwise extending structural supports including first and second structural supports formed from an electrically conductive material, the first support having a first shelf bracket and the second support having a second shelf bracket, the shelf brackets extending forwardly of their respective supports and formed from an electrically conductive material, the shelf brackets being electrically connected directly to their respective structural supports and being receptive to a shelf placed on the shelf brackets to support the shelf;

an electrical power supply connected electrically to the conductive material of the structural supports whereby the structural supports provide structural support for the system and also deliver power directly to the shelf brackets, whereby the structural supports may provide a sole electrical pathway to deliver power to the shelf brackets;

an electric light source attached to the underside of the shelf, the light source being connected in circuit with the shelf brackets and structural supports to complete the lighting circuit.

2. The illuminated shelving system as defined in claim 1 wherein the light source has a pair of leads and further comprising:

the shelf being separate from the brackets and being formed from an electrically conductive material;

the electrical connection between the light source and shelf bracket comprising a first of the leads being electrically connected to the conductive material of the first shelf bracket and the other lead being electrically connected to the conductive material of the shelf in the region of the first shelf bracket;

the shelf being electrically connected to the second shelf bracket, whereby the conductive material of the shelf forms part of the lighting circuit.

3. The illuminated shelving system as defined in claim 2 further comprising the supports, shelf brackets and shelves being jacketed with a non-conductive material.

4. The illuminated shelving system as defined in claim 3 wherein the shelf, shelf brackets and supports are formed from aluminum jacketed by an anodized surface layer.

5. The illuminated shelving system as defined in claim 2 wherein the connection of the shelf to the second shelf bracket comprises a conduction block mechanically and electrically secured to the shelf and the second shelf bracket.

6. The illuminated shelving system as defined in claim 5 further comprising the supports, shelf brackets and shelves being jacketed with a non-conductive material.

7. The illuminated shelving system as defined in claim 6 wherein the shelf, shelf brackets and supports are formed from aluminum jacketed by an anodized surface layer.

8. An illuminated shelving system comprising:

a shelf;

at least two spaced heightwise extending supports including first and second supports formed from an electrically conductive material, the first support having a first shelf bracket and the second support having a second shelf bracket, the shelf brackets extending forwardly of their respective supports and founed from an electrically conductive material, the shelf brackets being, electrically connected directly to, their respective supports and being receptive to a shelf placed on the shelf supports to support the shelf;

an electrical power supply connected across the supports;

a light source attached to the underside of the shelf, the light source being connected in circuit with the shelf brackets to complete the lighting circuit;

the shelf being formed from an electrically conductive material;

the electrical connection between the light source and shelf bracket comprising a portion of the underside of the shelf having a first electrically conductive surface mounted thereto, the first electrically conductive surface being electrically insulated from the shelf and being positioned to electrically couple to the first shelf bracket, one of he light source leads being electrically connected to the first conductive surface;

the other light source lead being electrically connected to a conductive portion of the shelf;

the underside of the shelf having an exposed second electrically conductive portion, the second conductive portion being adapted to be electrically coupled directly to an electrically conductive portion of the second shelf bracket, whereby the light source and power source are electrically connected by placement of the shelf on the shelf brackets with the first conductive surface and second conductive portion in contact, respectively, with the first and second shelf brackets.

9. The illuminated shelving system as defined in claim 3 wherein the first and second supports and the shelf supports are jacketed by a frangible layer of non-conductive material and where the configuration of the supports and brackets causes portions of the supports and brackets to mechanically interfere to cause portions of the non-conductive layers to be disrupted when the brackets are attached to their supports, thereby electrically connecting the supports and brackets.

10. The illuminated shelving system as defined in claim 9 wherein the shelf, shelf brackets and supports are formed from aluminum jacketed by an anodized surface layer.

11. An illuminated shelving system comprising:

a shelf;

at least two spaced heightwise extending supports including first and second supports formed from an electrically conductive material, the first support having a first shelf bracket and the second support having a second shelf bracket, the shelf brackets extending forwardly of their respective supports and formed from an electrically conductive material, the shelf brackets being electrically connected directly to their respective supports and being receptive to a shelf placed on the shelf supports to support the shelf;

an electrical power supply connected across the supports;

a light source attached to the underside of the shelf, the light source being connected m circuit with the shelf brackets to complete the lighting circuit;

wherein the first and second supports and the shelf supports are jacketed by a frangible layer of non-conductive material and where the configuration of the supports and brackets causes portions of the supports and brackets to mechanically interfere to cause portions of the non-conductive layers to be disrupted, when the brackets are attached to their supports, thereby electrically connecting the supports and brackets.

12. The illuminated shelving system as defined in claim 11 wherein the shelf, shelf brackets and supports are formed from aluminum jacketed by an anodized surface layer.

13. An illuminated shelving system comprising:

a shelf;

at least two spaced heightwise extending supports including first and second supports formed from an electrically conductive material, the first support having a first shelf bracket and the second support having a second shelf bracket, the shelf brackets extending forwardly of their respective supports and formed from an electrically conductive material, the shelf brackets being electrically connected directly to their respective supports and being receptive to a shelf placed on the shelf supports to support the shelf;

an electrical power supply connected across the supports to supply electrical power along the length and through the conductive material of the supports, whereby the structural supports may provide a sole electrical pathway to deliver power to the shelf brackets;

a light source attached to the underside of the shelf, the light source having leads connected in circuit with the shelf brackets to complete the lighting circuit;

the electrical connection between the light source and shelf bracket comprising one lead being electrically connected to the conductive material of one of the shelf brackets and another lead being electrically connected to the conductive material of the other of the shelf brackets, whereby the shelf brackets may comprise the sole electrical pathway to deliver power from the supports to the light source.

14. The illuminated shelving system as defined in claim 13 further comprising:

the underside of the shelf having first and second electrically conductive surfaces positioned to directly contact the electrically conductive first and second shelf brackets when the shelf is supported on the brackets, each of the leads being electrically connected to one of the first and second conductive surfaces.

15. The illuminated shelving system of claim 14 wherein the shelf is formed from electrically conductive material, one of the electrically conductive surfaces being electrically insulated from the shelf and the other of the electrically conductive surfaces comprises a portion of the conductive shelf material.

16. The illuminated shelving system of claim 13 wherein one of the structural supports comprises a positive terminal of the system and the other structural support comprises a negative terminal of the system.

17. The illuminated shelfing system of claim 13 wherein the shelf and brackets are separate components.

18. The illuminated shelving system of claim 1 wherein one of the structural supports comprises a positive terminal of the system and the other structural support comprises a negative terminal of the system.

19. The illuminated shelfing system of claim 1 wherein the shelf and brackets are separate components.

* * * * *